US011260448B2

(12) United States Patent
Matthias et al.

(10) Patent No.: US 11,260,448 B2
(45) Date of Patent: Mar. 1, 2022

(54) METHOD FOR THE PRODUCTION OF HOLLOW CHAMBER VALVES

(71) Applicant: FEDERAL-MOGUL VALVETRAIN GMBH, Barsinghausen (DE)

(72) Inventors: Thorsten Matthias, Hannover (DE); Antonius Wolking, Barsinghausen (DE); Guido Bayard, Dortmund (DE); Andreas Heinek, Bannewitz (DE)

(73) Assignee: Federal-Mogul Valvetrain GMBH, Barsinghausen (DE)

( * ) Notice: Subject to any disclaimer, the term of this patent is extended or adjusted under 35 U.S.C. 154(b) by 247 days.

(21) Appl. No.: 16/625,292

(22) PCT Filed: Mar. 6, 2018

(86) PCT No.: PCT/EP2018/055424

§ 371 (c)(1),
(2) Date: Dec. 20, 2019

(87) PCT Pub. No.: WO2019/001781

PCT Pub. Date: Jan. 3, 2019

(65) Prior Publication Data

US 2020/0156144 A1 May 21, 2020

(30) Foreign Application Priority Data

Jun. 29, 2017 (DE) ..... 102017114524.9

(51) Int. Cl.
*B21K 1/22* (2006.01)
*B21C 23/20* (2006.01)

(52) U.S. Cl.
CPC ..... *B21K 1/22* (2013.01); *B21C 23/205* (2013.01); *F01L 2303/00* (2020.05)

(58) Field of Classification Search
CPC ..... B21K 1/22; B21C 23/205; F01L 2303/00; F01L 3/14
See application file for complete search history.

(56) References Cited

U.S. PATENT DOCUMENTS 2,009,996 A * 8/1935 Gering, Jr. ..... F01L 3/14 29/888.451
5,458,314 A * 10/1995 Bonesteel ..... B21D 22/21 251/337
6,006,713 A 12/1999 Gebauer
(Continued)

FOREIGN PATENT DOCUMENTS

DE 10118032 A1 10/2002
EP 2325446 A1 5/2011
(Continued)

*Primary Examiner* — Ryan J. Walters
(74) *Attorney, Agent, or Firm* — Robert L. Stearns; Dickinson Wright, PLLC

(57) ABSTRACT

Disclosed is a method for the production of a valve body of a hollow chamber valve, said method comprising: providing a bowl-shaped semi-finished product having an annular wall, which surrounds a hollow chamber, and a bottom portion, followed by a lengthening of the wall and a final reducing of an outer diameter of the annular wall in order to obtain a predetermined valve shaft outside diameter of a valve that is to be produced. Further disclosed is a hollow chamber valve produced by means of said method.

10 Claims, 1 Drawing Sheet

(56) References Cited

U.S. PATENT DOCUMENTS

| | | | | |
|---|---|---|---|---|
| 9,427,795 | B2 * | 8/2016 | Morii | F01L 3/12 |
| 2014/0366373 | A1 * | 12/2014 | Morii | B23P 15/002 29/888.451 |
| 2020/0173318 | A1 * | 6/2020 | Matthias | F16K 49/007 |

FOREIGN PATENT DOCUMENTS

| | | | |
|---|---|---|---|
| EP | 2690262 | A1 | 1/2014 |
| EP | 2811126 | A1 | 12/2014 |
| JP | 2014084725 | A | 5/2014 |

* cited by examiner

METHOD FOR THE PRODUCTION OF HOLLOW CHAMBER VALVES

BACKGROUND

1. Technical Field

The present invention relates to a method for manufacturing hollow valves for an internal combustion engine, and hollow valves manufactured using the method.

2. Related Art

Intake valves and exhaust valves are components in internal combustion engines that are subject to high thermal and mechanical stress. Therefore, sufficient cooling is necessary to ensure long-term functionality of the valves. Compared to solid stem valves and hollow stem valves, hollow valves are advantageous due to the fact that a cavity is present in both the stem and the valve head, as the result of which improved internal cooling, using a coolant such as sodium, may be achieved. Further advantages are lower weight, avoidance of hot spots, and reduced $CO_2$.

Hollow valves are typically manufactured by a combination of various processes such as forging, turning, and welding. In particular turning or milling of the cavity is costly. In addition, weld spots on the disk surface or at other operationally critical locations should be avoided. Another disadvantage of known methods is that a large number of process steps are often necessary. For example, U.S. Pat. No. 6,006,713 A relates to a hollow valve that is manufactured by closing a hollow blank by welding.

An object is to provide a manufacturing method for hollow valves or a valve body for hollow valves which does not have the stated disadvantages, and at the same time has high productivity and good material utilization.

A method for manufacturing a valve body of a hollow valve includes the steps of providing a bowl-shaped semi-finished product, the semi-finished product having an annular wall that surrounds a cylindrical cavity of the semi-finished product, and a base section; forming a valve head from the base section; lengthening the annular wall in an axial direction by forming, wherein a mandrel is inserted into the cavity during the forming; reducing an outer diameter of the annular wall by rotary swaging to obtain a valve stem of the finished valve body having a predetermined outer diameter.

According to another aspect of the present invention, provision of the bowl-shaped semi-finished product may include providing an at least partially cylindrical blank, and forming the bowl-shaped semi-finished product from the blank.

According to another aspect, the forming of the bowl-shaped semi-finished product may take place via a hot forming process, in particular via backward can extrusion or forging.

According to another aspect, the forming of the valve head may take place via a hot forming process, in particular via backward can extrusion or forging.

According to another aspect, the lengthening of the annular side wall may take place via rotary swaging with a mandrel, or ironing via a mandrel.

According to another aspect, multiple mandrels having different diameters may be used during the lengthening of the annular wall.

According to another aspect, the diameters of successively used mandrels may decrease during the lengthening of the annular wall.

According to another aspect, the reduction of the outer diameter of the annular wall may include multiple rotary swaging substeps.

According to another aspect, the reduction of the outer diameter of the annular wall may take place without an inserted mandrel.

According to another aspect, the method may also comprise filling a coolant, in particular sodium, into the cavity and closing the valve stem.

According to the invention, the object is further achieved by a hollow valve that includes a valve body that has been manufactured using the above method.

BRIEF DESCRIPTION OF THE DRAWINGS

Exemplary embodiments of the invention are described in greater detail below with reference to the figures, which show the following.

DETAILED DESCRIPTION

Figures 1A, 1B, 1C, 1D, 1E, 1F:
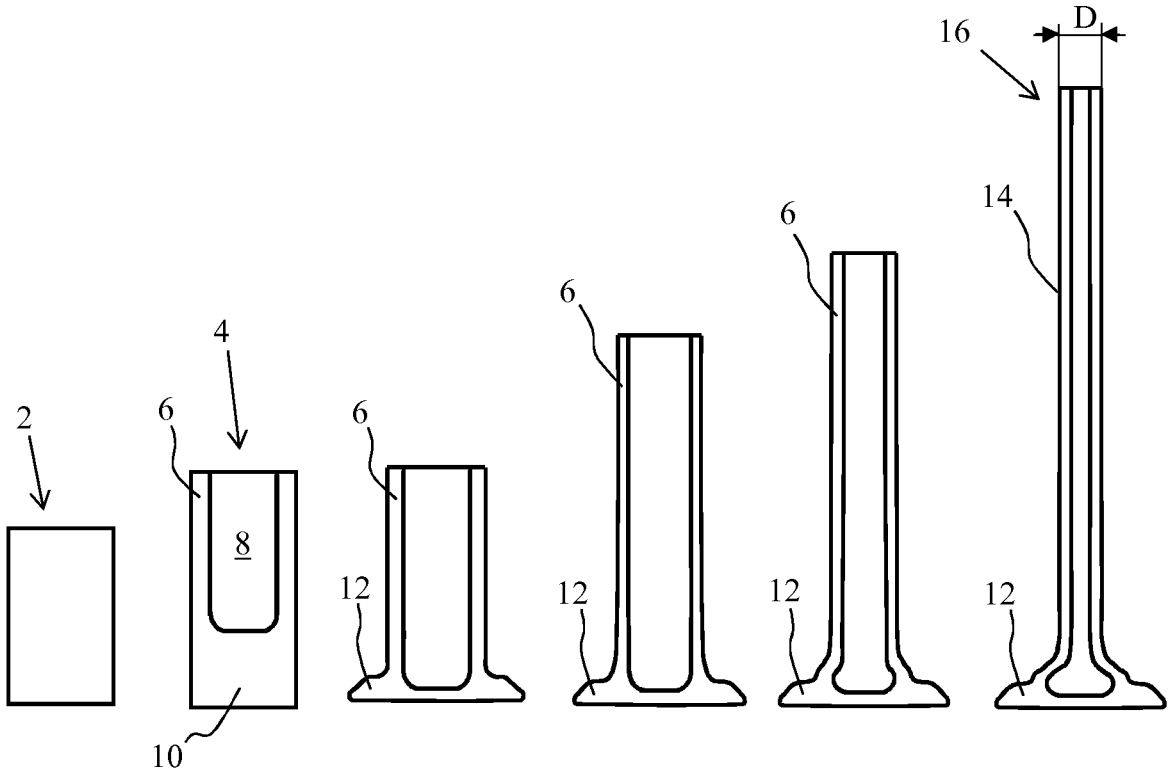
FIGS. 1A-1F show various intermediate steps of the manufacture according to an embodiment of a valve body of a hollow valve (illustrated in FIG. 1F) from a blank (illustrated in FIG. 1A).

FIGS. 1A through 1F show sectional views of intermediate steps of the manufacturing method according to an embodiment of the invention. A blank 2 made of a valve steel known to those skilled in the art is preferably used as the starting point (see FIG. 1A). The blank has an at least partially cylindrical shape, preferably a circular cylindrical shape, corresponding to the circular shape of the valve body or valve to be manufactured.

The blank 2 is formed into a bowl-shaped semi-finished product 4 or workpiece illustrated in FIG. 1B. The semi-finished product in the form of a bowl includes a base section 10, from which a valve head (or valve disk) 12 is subsequently formed, and an annular wall 6 that surrounds a cylindrical, preferably circular cylindrical, cavity 8 of the bowl-shaped semi-finished product 4, and from which a valve stem 14 is subsequently formed. In this regard, any material may flow between the base section 10 and the annular wall 6 during the subsequent forming steps. In general, according to the invention the bowl-shaped semi-finished product 4 is directly provided; the method then starts with providing the bowl-shaped semi-finished product 4 illustrated in FIG. 1B.

The valve head 12 is formed from the base section 10 in a subsequent forming step. The workpiece thus obtained is illustrated in FIG. 1C.

The forming of the blank 2 into a bowl-shaped workpiece 4 as well as the forming of the valve head 12 from the base section 10 is preferably carried out via a hot forming process; it is also preferred to use backward can extrusion or forging. During the backward can extrusion, a stamp is pressed into the blank 2 in order to form the cavity 8.

In the next machining step, an axial length of the annular wall 6 is increased. In this context, "axial" refers to the longitudinal direction defined by the stem, i.e., the axis of the annular wall; correspondingly, "radial" is a direction orthogonal to the axial direction. To achieve an effective increase in length, during this step a mandrel (not illustrated) is inserted into the cavity, so that flow of the material in the radial direction is prevented, and the material flow takes place primarily in the axial direction. The inner diameter and the wall thickness of the annular wall 6 may thus be adjusted to a desired value. In addition, this forming step may be made up of multiple substeps, in which multiple mandrels are optionally inserted in the order of decreasing diameter. The semi-finished product shapes thus achieved are illustrated by way of example in FIGS. 1D and 1E, in which initially a mandrel having a larger diameter is used to obtain the semi-finished product state illustrated in FIG. 1D, and a mandrel having a smaller diameter is subsequently used to obtain the state illustrated in FIG. 1E. Of course, it is also possible to use more than two mandrels having different diameters.

Rotary swaging with a mandrel or ironing via a mandrel is preferably used as a forming process for this lengthening or elongation.

Lastly, the outer diameter of the annular wall 6 is reduced by rotary swaging to obtain a finished valve body 16 whose valve stem 12 has a predetermined outer diameter D, i.e., a desired target diameter (see FIG. 1F). This forming step preferably takes place without an inserted mandrel, so that the diameter may be effectively reduced. This step results not only in a reduction of the outer diameter, but also in further lengthening of the annular wall 6 and, without a mandrel, results in an increase in the wall thickness of the annular wall. The wall thickness would thus optionally be set to be somewhat smaller in the preceding lengthening step in order to obtain a certain wall thickness, and thus a certain inner diameter for a given outer diameter D, taking into account the increased thickness in the final step.

The step for reducing the outer diameter of the annular wall 6 may be divided into multiple successive substeps, each of which is carried out by rotary swaging. This depends, among other things, on the diameter reduction to be achieved, i.e., the difference between the starting outer diameter of the bowl-shaped workpiece (FIG. 1E) and the predetermined outer diameter D of the finished valve stem 12 to be achieved (FIG. 1F). The individual substeps may take place independently of one another by rotary swaging, with or without a mandrel. If a large reduction in the diameter, and thus, a large number of substeps, is necessary, for example for at least some of the substeps a mandrel may be inserted so that the thickness of the annular wall 6 does not become too great.

It is important that, after the rotary swaging for reducing the outer diameter of the annular wall 6, no further forming step of the valve body 16 takes place, since this would adversely affect the beneficial material properties obtained by the rotary swaging. Rotary swaging is thus the final forming step. Rotary swaging is an incremental pressure forming process in which the workpiece to be machined is hammered in rapid succession from various sides in the radial direction. Due to the resulting pressure, the material "flows" in a manner of speaking, and the material structure is not distorted by tensile stresses. Rotary swaging is preferably carried out as a cold forming process, i.e., below the recrystallization temperature of the machined material.

Thus, a significant advantage of using rotary swaging as the final forming step is that during the rotary swaging, compressive stresses are induced by the radial transmission of force, thus preventing the occurrence of tensile stresses which increase the susceptibility to cracks; this is particularly applicable to the edge layers of the hollow stem. Such undesirable tensile stresses occur, for example, when drawing processes or "necking" (a retraction process, i.e., reducing the diameter by constriction) are used. Rotary swaging allows, among other things, uninterrupted grain flow in the workpiece. Further advantages of the rotary swaging as the final forming step, compared to drawing processes or necking, are a higher achievable surface quality and a relatively greater reduction in the diameter of the stem for each step. Due to the high level of achievable surface quality and as the result of the maintainable tolerances during rotary swaging being very small, post-machining of the valve stem is usually not necessary. With a free-form process or compression process, such as necking, generally only poorer surface quality or tolerance maintenance is achievable. Accordingly, after the rotary swaging, in particular no method step using a drawing process or necking takes place for reducing the outer diameter of the annular wall.

To complete the process for manufacturing the hollow valve, a coolant such as sodium may also be filled into the cavity of the valve body through the outwardly open end of the valve stem, and this end of the valve stem is subsequently closed, for example by a valve stem end piece, that is attached by friction welding, for example, or some other welding process (not illustrated in the figures).

The invention claimed is:

1. A method for manufacturing a valve body of a hollow valve, comprising the following steps:

providing a bowl-shaped semi-finished product, the semi-finished product having an annular wall that surrounds a cylindrical cavity that is open at a stem end of the semi-finished product, and a base section;

forming a valve head from the base section;

thereafter lengthening the annular wall in an axial direction by forming, wherein a mandrel is inserted into the cavity through the open stem end during the forming;

thereafter reducing an outer diameter of the annular wall by rotary swaging without a mandrel present in the cavity to obtain a valve stem of the valve body having a predetermined outer diameter (D);

wherein multiple mandrels having different diameters are used during the lengthening of the annular wall.

2. The method according to claim 1, wherein the provision of the bowl-shaped semi-finished product includes:

providing an at least partially cylindrical blank; and forming the bowl-shaped semi-finished product from the blank.

3. The method according to claim 2, wherein the forming of the bowl-shaped semi-finished product takes place via a hot forming process comprising backward can extrusion or forging.

4. The method according to claim 1, wherein the forming of the valve head takes place via a hot forming process comprising backward can extrusion or forging.

5. The method according to claim 1, wherein the lengthening of the annular side wall takes place via rotary swaging with a mandrel, or ironing via a mandrel.

6. The method according to claim 5, wherein the diameters of successively used mandrels decrease during the lengthening of the annular wall.

7. The method according to claim 1, wherein the reduction of the outer diameter of the annular wall includes multiple rotary swaging substeps.

8. The method according to claim 1, wherein the reduction of the outer diameter of the annular wall takes place without an inserted mandrel.

9. The method according to claim 1, further comprising:

filling a coolant into the cavity; and closing the valve stem.

10. The method of claim 9, wherein the coolant is sodium.

* * * * *